US005683067A

United States Patent [19]

Slykas

[11] Patent Number: 5,683,067

[45] Date of Patent: Nov. 4, 1997

[54] SEAT COVER HOLDER FOR A PORTABLE TOILET

[75] Inventor: Frank A. Slykas, Hollister, Calif.

[73] Assignee: Ajax Portable Services, Hollister, Calif.

[21] Appl. No.: 450,027

[22] Filed: May 25, 1995

[51] Int. Cl.[6] ..... A47F 7/00

[52] U.S. Cl. ..... 248/314; 248/309.1; 248/311.2

[58] Field of Search ..... 248/309.1, 311.2, 248/314; 224/925, 928; 4/449, 476

[56] References Cited

U.S. PATENT DOCUMENTS

| | | | |
|---|---|---|---|
| 435,310 | 8/1890 | King | 248/311.2 X |
| 825,774 | 7/1906 | Stumm | 248/314 X |
| 1,455,759 | 5/1923 | Erickson | 248/314 |
| 1,625,011 | 4/1927 | Wolfe et al. | 224/928 X |
| 2,639,880 | 5/1953 | Belloff et al. | 248/314 |
| 3,033,362 | 5/1962 | Marcalus | 224/928 X |
| 3,066,311 | 12/1962 | Tharp | 4/449 X |
| 4,285,077 | 8/1981 | Braxton | 4/449 X |
| 4,380,836 | 4/1983 | Braxton | 4/449 X |
| 4,846,385 | 7/1989 | Fratus | 248/314 X |
| 5,018,633 | 5/1991 | Toth et al. | 248/314 X |
| 5,054,732 | 10/1991 | Sukup | 248/309.1 |
| 5,129,615 | 7/1992 | Strauss | 248/311.2 |
| 5,398,465 | 3/1995 | Tagg | 4/449 X |
| 5,500,962 | 3/1996 | Tagg | 4/449 X |

FOREIGN PATENT DOCUMENTS

| | | | |
|---|---|---|---|
| 300380 | 11/1928 | United Kingdom | 248/314 |

*Primary Examiner*—Leslie A. Braun
*Assistant Examiner*—Richard M. Smith
*Attorney, Agent, or Firm*—Peninsula IP Group; Douglas A. Chaikin, Esq.

[57] ABSTRACT

A simple rugged holder for supporting a box of toilet seat covers for use in a portable toilet includes a front, sides, bottom and a mounting flange for attachment to a wall of the portable toilet. The holder is preferably made of molded plastic in one piece, the flange connecting the sides and bottom to define a space within which the box of seat covers is supported. A stiffening member is disposed along a top front edge of the front and serves also to guide the insertion of a box of seat covers into the defined space. The height, width and depth of the space are selected to allow easy insertion of a box of seat covers yet providing a sufficiently firm grip on the box to prevent inadvertent extraction from the holder when users forcefully remove tissue seat covers. An alternative embodiment is made of sheet metal.

4 Claims, 3 Drawing Sheets

SEAT COVER HOLDER FOR A PORTABLE TOILET

BACKGROUND OF THE INVENTION

1. Field of the Invention

This invention relates to portable toilets generally, and particularly to an apparatus for containing toilet seat cover dispensing boxes.

2. Previous Art

Toilet seat covers for portable toilets are generally dispensed from cardboard containers which allow a user to withdraw a single folded seat cover by grasping the cover in one or both hands and pulling upward and outward to release the cover from the container. The containers are usually placed inside a bracket assembly which attaches to an interior wall of the toilet in a location convenient to the user.

One common bracket assembly includes an outer shell having an opening, the shell surrounding the cardboard container and the opening providing access to the folded seat covers. A back portion of this popular bracket assembly forms a brace across an open rear of the shell and additionally serves as an attachment to the wall. Usually a couple of fasteners are used to fasten the back or brace portion to the wall.

The brace portion is made of plastic and is easily damaged during removal of seat covers from the wall mounted container. The damage usually includes the plastic brace forming a crack. Over time, as additional seat covers are withdrawn from the container, the brace eventually fails and the shell and seat cover container either fall to the floor, or down into the open toilet if mounted near the opening. Alternatively, the shell and cardboard container is left dangling in the hand of an embarrassed and frustrated user.

What is needed is a seat cover holder which does not break when used by thousands of persons, many of whom are in a hurry to escape to the fresh air or be otherwise about their business.

What is also needed is a strong holder which is simple and easy to manufacture and to mount on the wall of a portable toilet.

It is desirable to provide a strong, simple, easy to make and use holder which can be easily and rapidly loaded with a new box of seat covers so that a hasty removal or insertion of the cardboard container does not cause damage to the holder.

Finally, it is desirable to provide such a holder which is attractive to the eye and is easily cleaned.

SUMMARY OF THE INVENTION

It is an object of this invention to provide a cover holder which is strong and reliable and which will not break under normal use and servicing.

It is a further object of this invention to provide such a cover holder which is easy to manufacture and easy to mount upon the wall of a portable toilet.

It is an additional object of this invention to provide a cover holder which can be rapidly and safely loaded with a new box of tissue cover holders.

And finally it is an object of this invention to provide a cover holder as described here which is attractive and is easily cleaned.

In accordance with the above objects and those that will be mentioned and will become apparent below, the cover holder in accordance with this invention, comprises:

a rectangular front about as wide as the width of a box of seat covers;

rectangular sides and bottom attached to the front, enclosing both sides and the bottom and forming a container having a width and thickness adapted for holding the box of seat covers;

a flange connected essentially perpendicular to a rear edge of the sides and bottom in a plane parallel to the front, whereby when the flange is fastened to a portable toilet interior wall, the cover holder will hold a box of seat covers.

In a preferred embodiment, the cover holder is made as a single molded plastic article and the width and thickness of the holder are selected to fit a box of seat covers tight enough to allow the box to be inserted without crushing into the holder and yet not come out when a user removes a single cover from the box.

The preferred embodiment includes a portion along the upper edge of the front extending outwardly for stiffening the front.

Another preferred embodiment includes flanges along the two sides but not along the bottom. This embodiment is preferably made of folded sheet metal.

It is an advantage of this invention to provide a cover holder for use in portable toilets which is easy to make, durable, attractive, easy to service and is safe to use.

It is a further advantage of this invention to provide a cover holder which can be easily attached to the wall of the portable toilet and which can be easily cleaned during servicing.

BRIEF DESCRIPTION OF THE DRAWING

For a further understanding of the objects and advantages of the present invention, reference should be had to the following detailed description, taken in conjunction with the accompanying drawing figures, in which like parts are given like reference numerals in the various figures, and wherein.

DETAILED DESCRIPTION OF THE INVENTION

The invention will now be described with respect to FIG. 1, a perspective view of a cover holder according to a preferred embodiment of the present invention and depicted generally by the numeral 10. The cover holder 10 is illustrated holding a box 12 of industry standard toilet seat covers 14.

Figure 1:
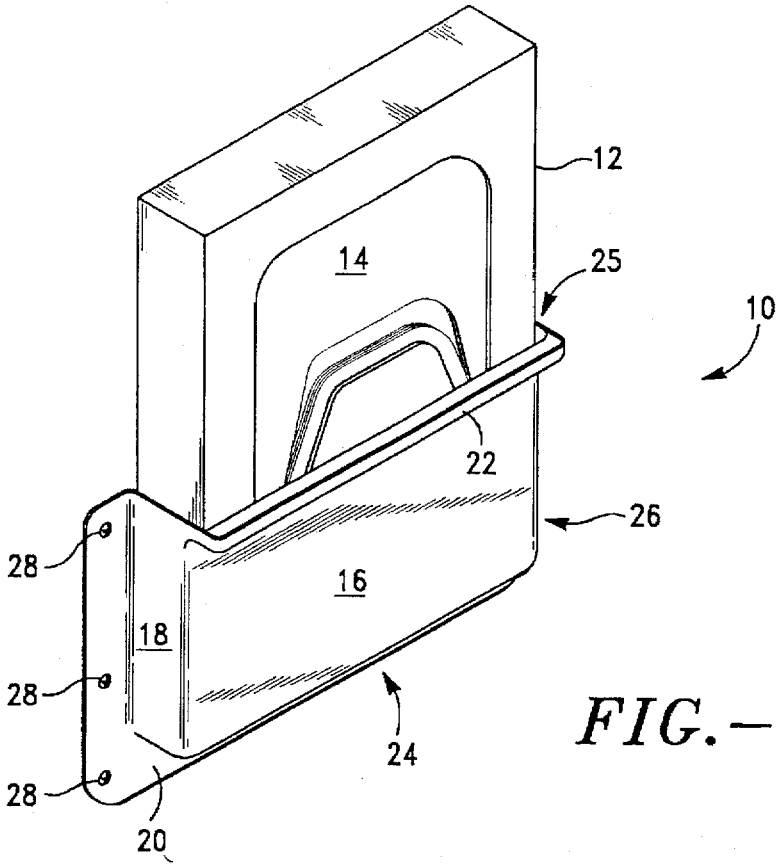
FIG. 1 is a perspective view of a cover holder in accordance with the present invention and including a box of toilet seat covers.

The cover holder 10 shown in FIG. 1 includes a from face 16, a left side 18, a mounting flange 20 and a guiding and stiffening lip 22. A bottom 24 and a right side 26 are indicated but cannot be seen in the perspective view of FIG. 1.

The front face 16, sides 18 and 26 and bottom 24 are joined to form a cover holder whose width, height and depth are adapted to enclose the lower portion of the industry standard size toilet seat cover box 12.

As illustrated in the embodiment shown in FIG. 1, the flange 20 is attached at a rear edge of sides 18 and 26 and bottom 24. The flange 20 extends outwardly in a plane generally parallel to the plane of the front face 16. The connection of the flange 20 to the sides 18, 26 and bottom 24 serves to strengthen these members by preventing the sides and bottom from deforming under load.

Figure 6:
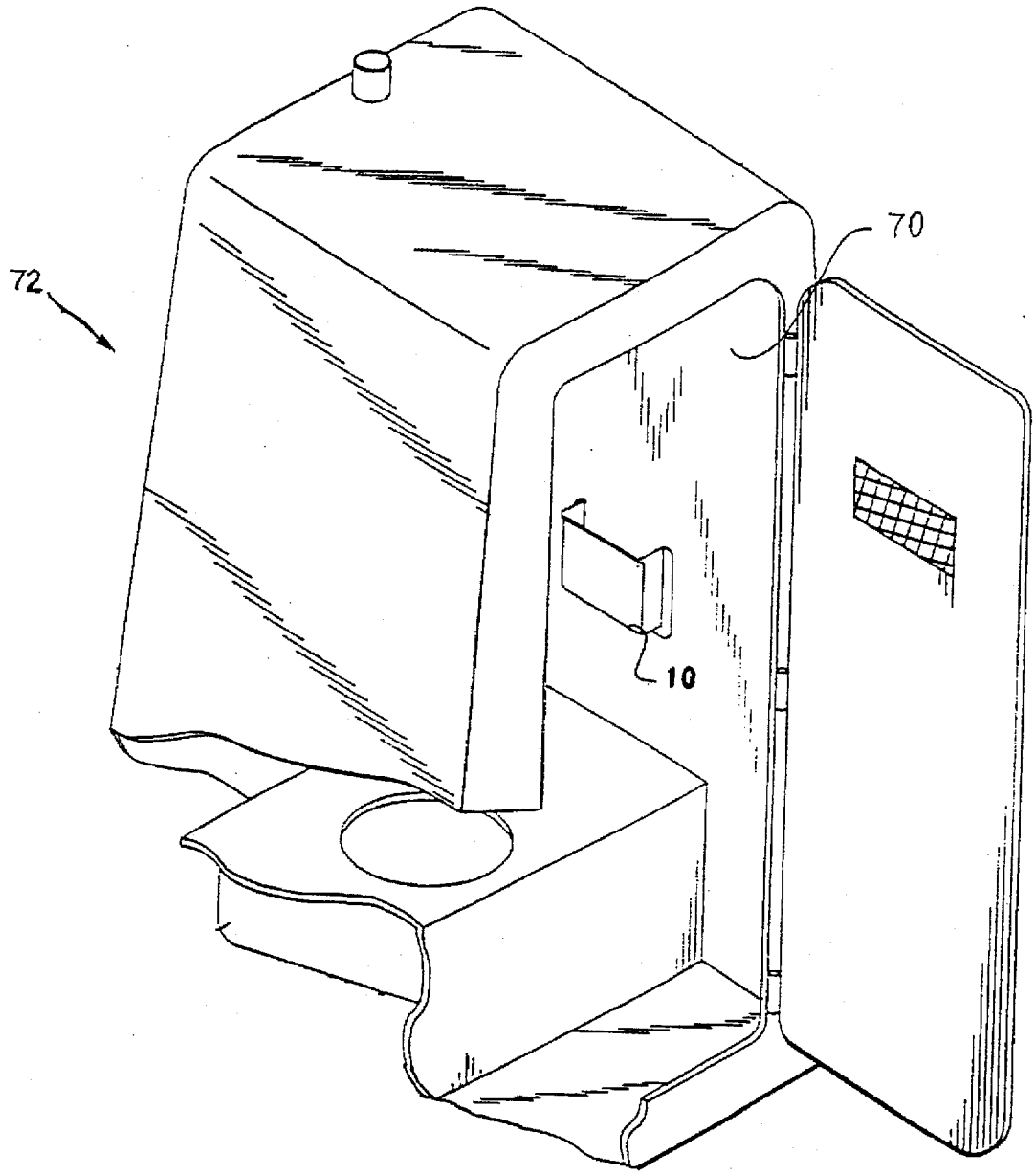
FIG. 6 is a cutaway perspective view of the cover holder attached to a portable toilet in accordance with the present invention.

In practice, the cover holder 10 is fastened to an interior wall 70 (FIG. 6) of a portable toilet 72 by attaching the flange 20 to the wall 70. In one embodiment, fasteners 28 are used for that purpose. In an alternative embodiment, the flange 20 may be bonded to the wall by applying a commonly available bonding agent such as an epoxy or glue to a rear side of the flange and then pressing the flange 20 against the wall at a desired location.

Figure 2:
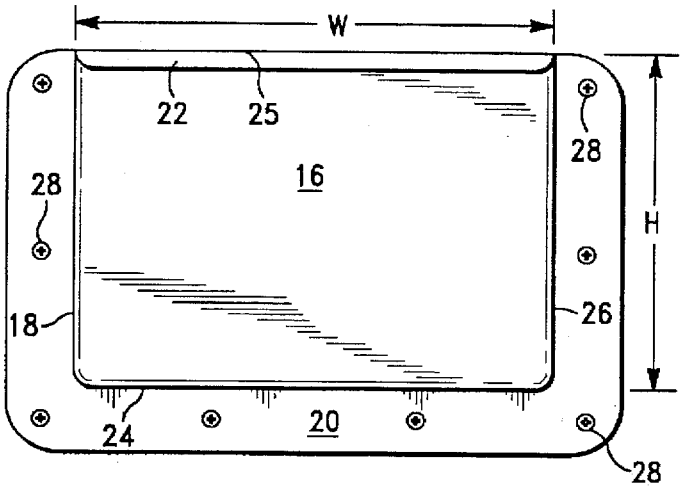
FIG. 2 is a front view of the cover holder illustrated in FIG. 1.

A front view of the cover holder 10 is shown in FIG. 2, which illustrates the front face 16, the left side 18, the flange 20, the guiding and stiffening lip 22, an open top 25, the fight side 26 and the fasteners 28. The size of the front face 16 is defined in terms of a width W and a height H. The width W is measured along a line essentially parallel with the bottom 24 and from one side 18 to the other side 26. The height H is measured along a line essentially parallel with either side 18 or 26 and between the bottom 24 and the open top 25.

Figure 3:
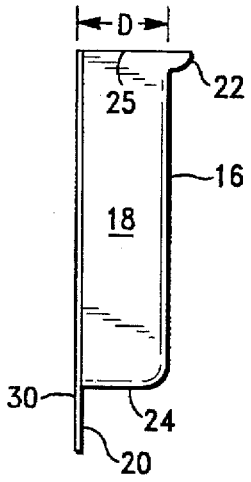
FIG. 3 is a side view of the cover holder illustrated in FIGS. 1 and 2.

A side view of the cover holder 10 is illustrated in FIG. 3, including the front face 16, the left side 18, the flange 20, the guiding and stiffening lip 22, the bottom 24, the open top 25 and a rear surface 30 of the flange 20. The depth of the cover holder 10 is defined in terms of a depth D, which is measured along a line essentially parallel with the bottom 24 and from the front face 16 to the rear surface 30.

In general, the height H, width W and depth D of the cover holder 10 are selected to allow the box 12 of seat covers 14 to be inserted into the cover holder 10 at the open top 25 without damage to the box 12. Yet, experience has shown that the fit between the box 12 and the cover holder 10 must be snug enough to prevent the box 12 from being dragged out of the cover holder 10 by a user's removal of a seat cover 14 from the box 12. Consequently, the production and inspection of the cover holders 10 must maintain a tolerance of fit between the cover holder 10 and the box 12 which is consistent with these competing goals.

In a preferred embodiment, the cover holder 10 is manufactured using a heat molding process and employs a material such as plastic. In this preferred embodiment, the guiding and stiffening lip 22 is more than an artifact of the molding process. In addition to stiffening the upper portion of the front face 16, the forward extension of the lip 22 from the front face 16 assists in guiding a replacement box 12 into the open top 25 of the cover holder 10.

Figure 4:
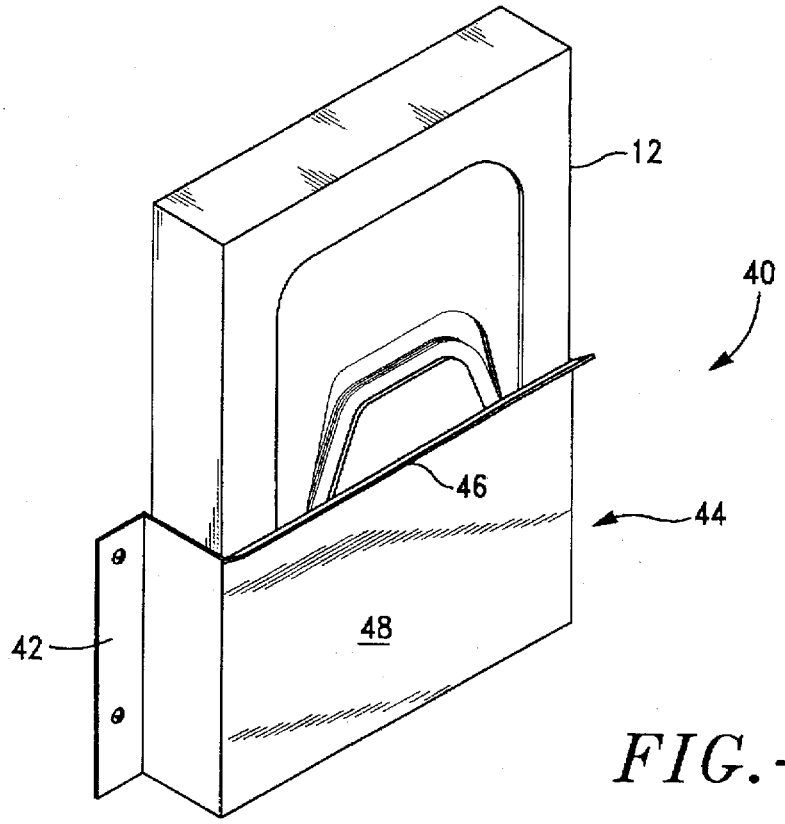
FIG. 4 is a perspective view of a second embodiment of the cover holder in accordance with the present invention.

A second embodiment of the cover holder is illustrated in FIG. 4, which is a perspective view of a cover holder including a box of seat covers. The cover holder is depicted generally by the numeral 40 and includes parts similar to those illustrated in the embodiment of FIG. 1. Note however that the single flange 20 of FIG. 1 is replaced by a left flange 42 and a right flange 44 (indicated but not visible in FIG. 4). Also note that the guiding and stiffening lip 22 of FIG. 1 is replaced by an outward folded member 46 which serves to stiffen the upper edge of a front face 48. The second embodiment is preferably made of sheet metal and the bottom portion (not visible in FIG. 4) is not attached to the bottom edge of the sides.

Though the cover holder 40 could be attached to a wall using bonding techniques, it is preferable to make the attachment using any of a variety of fasteners, such as screws. Bonding between the sheet metal and the usual plastic or painted surface of the typical portable toilet is believed to be somewhat less reliable than the common screw or bolt.

The height, width and depth of the cover holder 40 are selected to achieve the same results as those described above with respect to the cover holder 10. A firm fit without damage to the box 12 during insertion is desirable.

Figure 5:
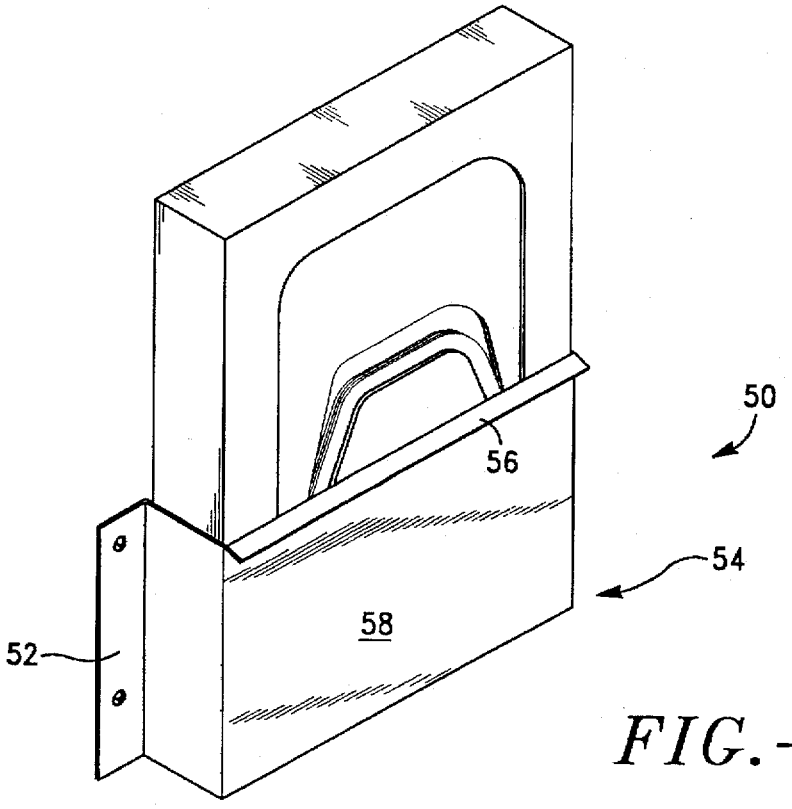
FIG. 5 is a perspective view of a third embodiment of the cover holder in accordance with the present invention.

A third embodiment of the cover holder is illustrated in FIG. 5. The cover holder is depicted generally by the numeral 50, and includes a left flange 52, a right flange 54 (indicated but not visible in FIG. 5), a downward folded member 56 and a front face 58. This embodiment is preferably made of sheet metal. The third embodiment differs from the second embodiment in that the guiding and stiffening lip 56 is folded outward and downward.

While the foregoing detailed description has described several embodiments of the device in accordance with this invention, it is to be understood that the above description is illustrative only and not limiting of the disclosed invention. Thus, the invention is to be limited only by the claims as set forth below.

What is claimed is:

1. A portable toilet in combination with a toilet seat cover holder and a box of toilet seat covers, comprising:

a portable toilet; a box of toilet seat covers;

a seat cover holder mounted on the portable toilet, the cover holder holding a box of toilet seat covers, the cover holder having a front face being approximately rectangular and having top, bottom and side edges; two sides, each being approximately rectangular and being attached to and essentially perpendicular to the side edges of the front face; a bottom, being approximately rectangular and being attached to and essentially perpendicular to the bottom edge of the front face and to each of the sides; the front face, bottom and sides defining a space being open at the top and closed along two sides, a bottom and front, and having a height, width and depth being adapted for holding a rectangular object; a flange extending outwardly from, and along a rear edge of, each side in a plane essentially parallel to the front face, whereby when the flange is fastened to the portable toilet interior wall, the cover holder will form a complete support for holding the box of toilet seat covers.

2. The cover holder as set forth in claim 1, further including the flange extending outwardly from, and along a rear edge of, the bottom.

3. The cover holder as set forth in claim 2, wherein an upper edge of the rectangular front face extends outwardly from the front, forming a stiffening element along the upper edge.

4. The cover holder as set forth in claim 3, wherein the front, sides, bottom and flange are made of a single molded plastic piece.

* * * * *